US011220655B2

(12) United States Patent
DelCotto

(10) Patent No.: US 11,220,655 B2
(45) Date of Patent: Jan. 11, 2022

(54) WOOD WICK COATED WITH SHAVINGS

(71) Applicant: Melynda S DelCotto, North Huntingdon, PA (US)

(72) Inventor: Melynda S DelCotto, North Huntingdon, PA (US)

(73) Assignee: Melynda S. Del Cotto, North Huntingdon, PA (US)

( * ) Notice: Subject to any disclaimer, the term of this patent is extended or adjusted under 35 U.S.C. 154(b) by 158 days.

(21) Appl. No.: 15/072,850

(22) Filed: Mar. 17, 2016

(65) Prior Publication Data

US 2016/0272922 A1 Sep. 22, 2016

Related U.S. Application Data

(60) Provisional application No. 62/134,942, filed on Mar. 18, 2015.

(51) Int. Cl.

| | |
|---|---|
| ***C11C 5/00*** | (2006.01) |
| ***F23D 3/08*** | (2006.01) |
| ***F23D 3/16*** | (2006.01) |

(52) U.S. Cl.

CPC ..... *C11C 5/006* (2013.01); *F23D 3/08* (2013.01); *F23D 3/16* (2013.01)

(58) Field of Classification Search

CPC ..... C11C 5/006; F23D 3/08; F23D 3/16
See application file for complete search history.

(56) References Cited

U.S. PATENT DOCUMENTS

| | | | |
|---|---|---|---|
| 52,231 | A | 1/1866 | Walton |
| 59,839 | A | 11/1866 | Hoard |
| 123,917 | A | 2/1872 | Ladd |
| 133,973 | A | 12/1872 | Everett |
| 170,158 | A | 11/1875 | Cushing |
| 170,995 | A | 12/1875 | Daniels |
| 197,902 | A | 12/1877 | Scott |
| 239,855 | A | 4/1881 | Schneider |
| 252,590 | A | 1/1882 | Loper |
| 275,293 | A | 4/1883 | Tisdale |
| 276,602 | A | 5/1883 | Kirk |
| 323,058 | A | 7/1885 | Mitchell |
| 383,822 | A | 5/1888 | Munger |
| 415,231 | A | 11/1889 | Walters |
| 431,033 | A | 7/1890 | Chapin |
| 436,509 | A | 9/1890 | Walters |
| 486,966 | A | 11/1892 | Elsinger |
| 731,033 | A | 6/1903 | Freeman |
| 747,282 | A | 12/1903 | Wallgren |
| 827,066 | A | 7/1906 | Hafner |

(Continued)

FOREIGN PATENT DOCUMENTS

| | | |
|---|---|---|
| DE | 314258 | 9/1918 |
| EP | 1245663 | 10/2002 |

(Continued)

OTHER PUBLICATIONS

Nussle, W., "Candle Crafting From An Art To A Science", A.S. Barnes and Co., Inc., (1971), pp. 16-17.

(Continued)

*Primary Examiner* — Alfred Basichas

(74) *Attorney, Agent, or Firm* — Element IP, PLC

(57) ABSTRACT

Wood coated planar candle wick is disclosed. The wood wick comprises a planar body, and a shaving adhered to at least one side of the planar body.

26 Claims, 4 Drawing Sheets

(56) References Cited

U.S. PATENT DOCUMENTS

| | | | |
|---|---|---|---|
| 1,267,968 | A | 5/1918 | Bulle |
| 1,320,109 | A | 10/1919 | Wooster |
| 1,389,490 | A | 8/1921 | Cook et al. |
| 1,475,134 | A | 11/1923 | Oakes |
| 1,576,205 | A | 3/1926 | Mertens |
| 1,636,709 | A | 7/1927 | Schmidt |
| 1,657,391 | A | 1/1928 | Haney |
| 1,660,760 | A | 2/1928 | Murphy |
| 1,756,885 | A | 4/1930 | Schafer |
| 1,831,902 | A | 11/1931 | Brown |
| 1,841,690 | A | 1/1932 | Weindel, Jr. |
| 1,961,920 | A | 6/1934 | Arpin |
| 2,015,383 | A | 9/1935 | Konig et al. |
| 2,107,054 | A | 2/1938 | Haymond |
| D111,775 | S | 10/1938 | Seaver |
| 2,168,698 | A | 8/1939 | Bunt et al. |
| 2,241,167 | A | 5/1941 | Storck |
| 2,324,753 | A | 7/1943 | Alexiade |
| 2,354,343 | A | 7/1944 | Webber et al. |
| 2,373,512 | A | 4/1945 | Starner |
| 2,376,083 | A | 5/1945 | Quinn |
| 2,464,361 | A | 3/1949 | Wilson |
| 2,570,841 | A | 10/1951 | O'Connor |
| 2,611,254 | A | 9/1952 | Byrnes |
| D178,200 | S | 7/1956 | McKenzie et al. |
| 2,758,460 | A | 8/1956 | Ciano |
| 2,809,512 | A | 10/1957 | Hartnett |
| 2,811,428 | A | 10/1957 | Smith |
| 2,959,950 | A | 11/1960 | Weglin |
| 3,039,283 | A | 6/1962 | Buscemi |
| 3,086,658 | A | 4/1963 | Palmer |
| 3,175,876 | A | 3/1965 | Fredericks |
| 3,269,807 | A | 8/1966 | Key, Jr. |
| 3,286,492 | A | 11/1966 | Frazier, Jr. |
| 3,367,758 | A | 2/1968 | Ambrose et al. |
| 3,380,797 | A | 4/1968 | Summers |
| 3,428,409 | A | 2/1969 | Summers |
| 3,462,235 | A | 8/1969 | Summers |
| 3,466,135 | A | 9/1969 | Summers |
| 3,495,924 | A | 2/1970 | Seni et al. |
| 3,560,122 | A | 2/1971 | Cassar |
| 3,582,251 | A | 6/1971 | Concannan |
| 3,637,335 | A | 1/1972 | Uhl |
| 3,652,197 | A | 3/1972 | Tokarz |
| 3,706,523 | A | 12/1972 | Kumm |
| 3,759,478 | A | 9/1973 | Schmitt et al. |
| 3,761,702 | A | 9/1973 | Andeweg |
| 3,883,143 | A | 5/1975 | Kelley et al. |
| 3,998,922 | A | 12/1976 | Weiss |
| 4,304,547 | A | 12/1981 | Buzil |
| 4,380,200 | A | 4/1983 | Reninger |
| 4,381,914 | A | 5/1983 | Ferguson |
| 4,386,904 | A | 6/1983 | Miyahara et al. |
| 4,449,987 | A | 5/1984 | Lindauer |
| 4,477,249 | A | 10/1984 | Ruzek et al. |
| 4,557,687 | A | 12/1985 | Schirneker |
| 4,568,269 | A | 2/1986 | Lin |
| 4,568,270 | A | 2/1986 | Marcus et al. |
| 4,682,947 | A | 7/1987 | Luken, Jr. |
| 4,696,640 | A | 9/1987 | Pitchford |
| 4,725,286 | A | 2/1988 | Brame |
| 4,804,323 | A | 2/1989 | Kim |
| D301,749 | S | 6/1989 | Comstock |
| 4,839,144 | A | 6/1989 | Martin |
| 4,855,098 | A | 8/1989 | Taylor |
| 4,917,597 | A | 4/1990 | Henze |
| 5,015,175 | A | 5/1991 | Lee |
| 5,069,617 | A | 12/1991 | Lin |
| D350,566 | S | 9/1994 | Pearson |
| 5,354,197 | A | 10/1994 | Barone |
| 5,363,590 | A | 11/1994 | Lee |
| 5,487,658 | A | 1/1996 | Lee |
| 5,597,300 | A | 1/1997 | Wohl et al. |
| 5,683,239 | A | 11/1997 | Cardosi |
| 5,683,762 | A | 11/1997 | Banschick |
| 5,690,484 | A | 11/1997 | Leonard et al. |
| 5,762,487 | A | 6/1998 | Kujawski |
| 5,772,424 | A | 6/1998 | Nokelainen |
| D397,459 | S | 8/1998 | Hsu |
| 5,807,096 | A | 9/1998 | Shin et al. |
| 5,830,245 | A | 11/1998 | Raddon |
| 5,842,850 | A | 12/1998 | Pappas |
| 5,846,070 | A | 12/1998 | Kim et al. |
| 5,879,153 | A | 3/1999 | Slejertin |
| 5,967,769 | A | 10/1999 | Thompson |
| 6,017,373 | A | 1/2000 | Frisch |
| 6,033,210 | A | 3/2000 | Freeman |
| 6,063,144 | A | 5/2000 | Calzada et al. |
| 6,068,472 | A | 5/2000 | Freeman et al. |
| 6,074,199 | A | 6/2000 | Song |
| 6,076,515 | A | 6/2000 | Smith |
| 6,129,771 | A | 10/2000 | Ficke |
| 6,214,295 | B1 | 4/2001 | Freeman |
| 6,214,512 | B1 | 6/2001 | Freeman et al. |
| 6,276,925 | B1 | 8/2001 | Varga |
| D456,537 | S | 4/2002 | Leeds |
| D458,394 | S | 6/2002 | Leeds |
| D459,498 | S | 6/2002 | Araujo |
| 6,405,441 | B1 | 6/2002 | Rucker |
| 6,409,501 | B1 | 6/2002 | Pappas |
| 6,419,713 | B1 | 7/2002 | Durand et al. |
| 6,440,184 | B2 | 8/2002 | Noda et al. |
| 6,444,156 | B1 | 9/2002 | Schwarz et al. |
| 6,454,561 | B1 | 9/2002 | Colthar et al. |
| 6,471,899 | B2 | 10/2002 | Daiber et al. |
| D466,632 | S | 12/2002 | Lablaine |
| 6,508,644 | B1 | 1/2003 | Pesu et al. |
| 6,554,448 | B2 | 4/2003 | Carpenter |
| 6,568,934 | B1 | 5/2003 | Butler |
| D481,142 | S | 10/2003 | Leeds |
| 6,783,356 | B2 | 8/2004 | Hermanson |
| D496,474 | S | 9/2004 | Murdick |
| 6,793,697 | B2 | 9/2004 | Sprules et al. |
| 6,823,780 | B2 | 11/2004 | Vogt et al. |
| 6,921,260 | B2 | 7/2005 | Garnys |
| 6,991,453 | B2 | 1/2006 | Decker et al. |
| D590,078 | S | 4/2009 | Horenziak et al. |
| 7,524,339 | B2 | 4/2009 | Decker et al. |
| 7,568,913 | B2 | 8/2009 | Decker et al. |
| 7,850,444 | B2 | 12/2010 | Kubicek et al. |
| D637,741 | S | 5/2011 | Horenziak et al. |
| D643,554 | S | 8/2011 | Decker |
| D644,359 | S | 8/2011 | Decker |
| D644,360 | S | 8/2011 | Decker |
| D658,316 | S | 4/2012 | van Dijk |
| D663,450 | S | 7/2012 | Delcotto et al. |
| D669,615 | S | 10/2012 | Delcotto et al. |
| 8,348,662 | B2 | 1/2013 | Decker |
| D678,558 | S | 3/2013 | Decker |
| 8,708,694 | B2 | 4/2014 | Delcotto et al. |
| D705,459 | S | 5/2014 | Decker |
| D708,777 | S | 7/2014 | Delcotto et al. |
| D715,989 | S | 10/2014 | Delcotto et al. |
| 8,961,171 | B2 | 2/2015 | Decker |
| 9,039,409 | B2 | 5/2015 | Decker |
| 9,120,995 | B2 | 9/2015 | Delcotto et al. |
| D740,461 | S | 10/2015 | Decker |
| 9,261,275 | B2 | 2/2016 | Decker |
| 9,410,696 | B2 | 8/2016 | Decker |
| 2001/0029003 | A1 | 10/2001 | Zou |
| 2001/0043469 | A1 | 11/2001 | Carpenter et al. |
| 2002/0001344 | A1 | 1/2002 | Jones et al. |
| 2002/0018976 | A1 | 2/2002 | Zou |
| 2002/0022205 | A1 | 2/2002 | Elliott et al. |
| 2003/0036028 | A1 | 2/2003 | Pesu et al. |
| 2003/0162142 | A1 | 8/2003 | Bennetts et al. |
| 2004/0008509 | A1 | 1/2004 | Decker et al. |
| 2004/0009447 | A1 | 1/2004 | Decker |
| 2004/0029061 | A1 | 2/2004 | Dibnah et al. |
| 2004/0033463 | A1 | 2/2004 | Pesu et al. |
| 2005/0037307 | A1 | 2/2005 | Decker et al. |
| 2005/0037308 | A1 | 2/2005 | Decker |
| 2005/0115145 | A1 | 6/2005 | Decker et al. |
| 2008/0153046 | A1 | 6/2008 | Delcotto et al. |

(56) References Cited

U.S. PATENT DOCUMENTS

| | | | |
|---|---|---|---|
| 2011/0024945 | A1 | 2/2011 | Decker |
| 2011/0027735 | A1 | 2/2011 | Decker |
| 2011/0027736 | A1 | 2/2011 | Decker |
| 2011/0027737 | A1 | 2/2011 | Decker |
| 2012/0064467 | A1 | 3/2012 | Delcotto et al. |
| 2012/0129114 | A1 | 5/2012 | Barresi |
| 2012/0148966 | A1 | 6/2012 | Ramaker et al. |
| 2012/0202160 | A1 | 8/2012 | Ford |
| 2012/0225392 | A1 | 9/2012 | Decker |
| 2012/0264069 | A1 | 10/2012 | Ramirez |
| 2013/0095440 | A1 | 4/2013 | Cagle et al. |
| 2013/0112346 | A1 | 5/2013 | Cagle et al. |
| 2015/0322379 | A1 | 11/2015 | Delcotto et al. |

FOREIGN PATENT DOCUMENTS

| | | | |
|---|---|---|---|
| FR | 2639356 | A1 | 5/1990 |
| FR | 2725372 | A1 | 4/1996 |
| FR | 2726573 | A1 | 5/1996 |
| FR | 2811676 | A1 | 1/2002 |
| GB | 16702 | | 3/1915 |
| GB | 191516702 | A | 3/1916 |
| GB | 118741 | | 11/1917 |
| GB | 1 238 214 | | 9/1968 |
| GB | 1 558 713 | | 3/1977 |
| JP | 2932371 | | 5/1999 |
| SE | 9903818 | | 5/2000 |

OTHER PUBLICATIONS

Olden, D., "Candles That Earn", Peanut Butter Publishing, (1990), Chapters, pp. 153-160.

Olden, D., "Candles That Earn", Peanut Butter Publishing, (1990), Chapter 7, pp. 133-153.

Robbins, F.W., The Story Of The Lamp (And The Candle), (Reprint—1970), Kingsmead Reprints, Bath, pp. 16-23.

Firewood For Your Fireplace; Warren Donnelly; Oct. 1974; 18,25,34,35,37,84,85,88-95.

www.CLARLUSSP.com/candles/index.php, "Waxes: Candles." Internet printout on Jul. 6, 2006, 1 page.

www.wetestit.com/wax.htm, "WAX." Internet printout on Jul. 6, 2006, 3 pages.

Improvements Catalog, [Online], [Retrieved on Jan. 11, 2005], Retrieved from the Internet: http://www.improvmentscatalog.com/Parent.asp?product=240717x&dept%5Fid=300&subdept%5Fid=304>.

World Flame Catalog, [Online], [Retrieved on Jan. 11, 2005], Retrieved from the Internet: http://www.golightheworld.com/Store/ProductJCategoryInfo.aspx?cid=7>.

World Flame Catalog, [Online], [Retrieved on Jan. 11, 2005], Retrieved from the Internet: http://www.golightheworld.com/Store/Product/CategoryInfor.aspx?cid=17>.

Norma Coney, 2000, Lark Books, Deborah Morgenthal, pp. 16, 49-50, & 55-58.

Request for Ex Parte Reexamination of U.S. Pat. No. 8,961,171, dated Apr. 29, 2016.

Request for Ex Parte Reexamination of U.S. Pat. No. 8,961,171; Replacement Detailed Request dated Jun. 10, 2016.

Internet Article, "Wood Candle Wicks—Cracking Wooden Wicks," http://www.woodcandlewick.com, p. 1-6 (Sep. 28, 2015).

Internet Article, "Wood Candle Wicks—Crackling Wooden Wicks," http://www.woodcandlewick.com, p. 1-6 (Sep. 28, 2015).

Wood Handbook, Wood as an Engineering Material, Centennial Edition, USDA (Apr. 2010).

Global Design Database, Registration No. 49900086-0001 (Apr. 11, 2019).

Global Design Database, Registration No. 40100590-0029 (Apr. 11, 2019).

European Office Action dated Aug. 30, 2017, in European Patent Application No. 12 191 762.9.

WOOD WICK COATED WITH SHAVINGS

This application claims priority to U.S. Provisional Patent Application No. 62/134,942, filed on Mar. 18, 2015, which is incorporated herein by reference in its entirety.

FIELD OF THE INVENTION

The present invention relates, in general, to wicks for candles and, more particularly, this invention relates to a wood wick comprising shavings, candles with wood wicks comprising shavings, and methods of making such wood wicks and candles.

BACKGROUND OF THE INVENTION

There have been attempts to use wood wicks for candles. Natural candle wax is difficult to burn safely with current wicks. Single wicks, or wicks with one planar booster provide a flame that is insufficient for the wax to burn completely. Many candles have more than one wick resulting in high temperatures and unsafe burning candles. If more than one wick is used, the flame may be too hot and unsafe.

SUMMARY OF THE INVENTION

By using one wick that has shavings and infused with all-natural substances, the flame is kept at a low temperature, but still hot enough to safely melt the wax. This provides for safe burning of a candle wherein the wax can be completely melted.

The present invention relates to wood wicks comprising a planar body and coated with shavings.

One embodiment of the invention is a wood wick. The wood wick comprises a planar body. Shavings are adhered to at least one side of the planar body.

Another embodiment of the invention is a candle. The candle comprises a meltable fuel and a wood wick. The wood wick comprises a planar body. Shavings are adhered to at least one side of the the planar body. The wood wick is partially within the meltable fuel wherein a portion of the wood wick extends beyond a top of the meltable fuel.

Another embodiment of the invention is a method of manufacturing a wood wick. The method comprises providing a planar body. An adhesive is applied over at least one side of the planar body. Shavings are applied to the adhesive.

Another embodiment of the invention is a method of manufacturing a candle. The method comprises inserting a wood wick into a meltable fuel. The wood wick comprises a planar body. Shavings are adhered to the planar body.

In another embodiment, the invention is a wood wick consisting essentially of a single planar body, an adhesive and shavings. In this embodiment, the wood wick may further consist essentially of an oil infused into the wood wick or planar body. It may further consist essentially of a solution infused into the wood wick or planar body wherein that solution consists essentially of salt water and/or vinegar.

In another embodiment, the invention is a wood wick consisting of a single planar body, an adhesive and shavings. In this embodiment, the wood wick may further consist of an oil infused into the wood wick or planar body. It may further consist of a solution infused into the wood wick or planar body wherein that solution consists of salt water and/or vinegar.

BRIEF DESCRIPTION OF THE D WINGS

DESCRIPTION OF THE INVENTION

Figure 1:
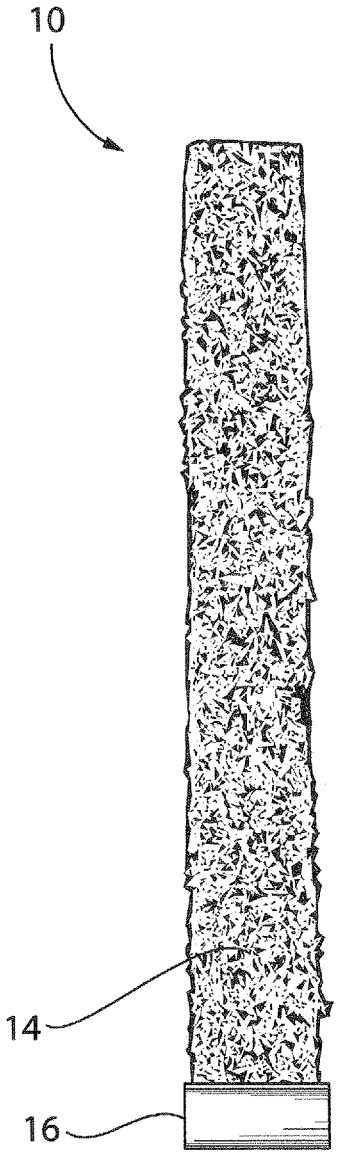
FIG. 1 is a front view of a wick coated with shavings on at least one side in a sustainer.
Figure 2:
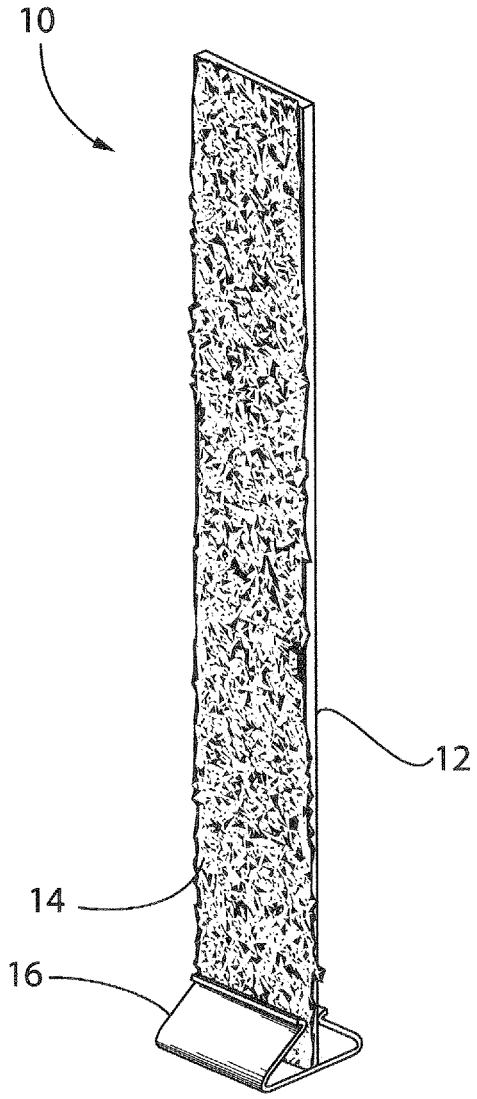
FIG. 2 is a perspective view of a wick with shavings on at least one side in a sustainer.
Figure 4:
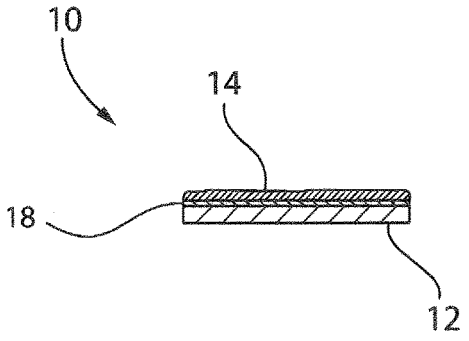
FIG. 4 is a top view of a wick with shavings on at least one side.
Figure 3:
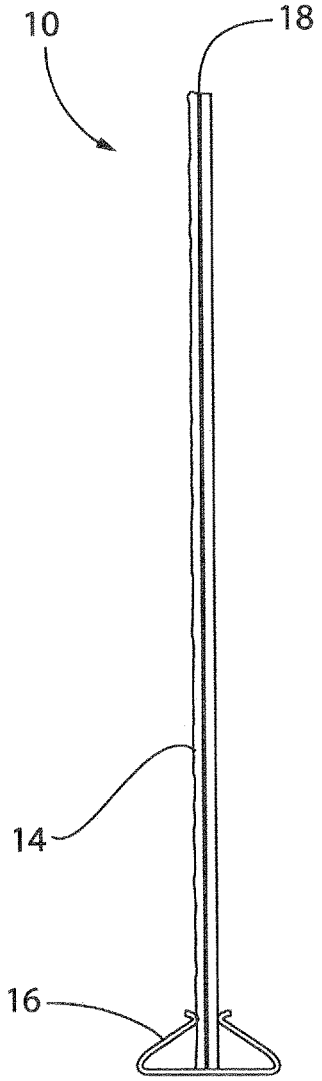
FIG. 3 is a side view of a wick with shavings on at least one side in a sustainer.

The object of the invention is to provide a wood wick coated in shavings.

The wood wick comprises a planar body. The planar body can be made of any wood or wood-like material. The planar body has a predetermined width, a predetermined thickness, and a predetermined length. In one embodiment of the invention, the first predetermined length will generally be between about 4.375 and about 5.125 inches, up to about 10 inches, up to about 8 inches or up to about 6 inches. In another embodiment, the first predetermined width will generally be between about 0.7 inch and about 0.8 inch, up to about 1 inch, greater than about 0.06 inches or between about 0.6 inches and about 1 inch. In another embodiment, the planar body is a board. In this embodiment, the board may be cut to a predetermined width and length at any time within the method to form the wood wick, or preferably after the board has been coated with the shavings.

An adhesive is applied over at least a portion of one side or two sides of the planar body or board. Preferably, the adhesive is applied over the entire side of the planar body or board, or on all sides of the planar body or board. The adhesive may be any adhesive useful in adhering materials to wood or wood-like material. The adhesive may be a natural adhesive, such as a vegetable based adhesive.

Shavings are applied over at least a portion of the adhesive. Preferably, the shavings are applied over the adhesive. The shavings may be any shaving from a wood or wood-like material, such as saw dust or wood flour. The shavings may be saw dust from oak, cherry, maple, poplar, wenge, rosewood, or bamboo. The shavings may be natural shavings. Natural shavings are shavings created from materials grown in nature.

The shavings have a coarseness. The coarseness has a grade A to grade CC. The coarseness may be grade A, grade B, grade C, or grade CC.

In one embodiment, the wick is infused with oil. This is done by letting the planar body or planar body and shavings soak in oil by spraying the oil onto the planar body (or board) or planar body (or board) and shavings. While any oil may be used, in one embodiment, the oil is a vegetable oil. In another embodiment, the oil is soy oil. The oil aids in a consistent burn of the wick.

In another embodiment, the wick is infused with a solution. The planar body (or board) or planar body (or board) and shavings may be soaked in the solution; or the solution may be sprayed to the planar body or planar body and shavings. The solution may comprise salt water, vinegar, or a combination of salt water and vinegar.

The salt water has a water to salt ratio (in terms of pounds) of 10 to 60 lbs of water to 1 lb of salt; 20 to 50 lbs of water to 1 lb of salt; 25 to 45 lbs of water to 1 lb of salt; 28 to 40 lbs of water to 1 lb of salt; 30 to 35 lbs of water to 1 lb of salt; 32 to 34 lbs of water to 1 lb of salt; or 33 to 34 lbs of water to 1 lb of salt. The salt may be any salt, including any edible salt. For example, the salt may be Anglesey sea salt, alacea salt, black lava salt, brine, butter salt, celery salt, curing salt, dairy salt, flake salt, fleur de sel, garlic salt, halite, Himalayan salt, jukyeom, Kala namak, kosher salt, LoSalt, pickling salt, sal de tavira, sale marino di Trapani, sea salt, sel gris, sel de guérande, smoked salt, or truffle salt. Alternatively, the salt may comprise calcium chloride, calcium nitrate, lithium chloride, lithium nitrate, potassium chloride, potassium nitrate, magnesium chloride, magnesium nitrate, sodium chloride or sodium nitrate.

The vinegar may be 5 to 20 percent acetic acid; 7 to 15 percent acetic acid; 8 to 12 percent acetic acid or about 10 percent acetic acid. In the embodiment wherein the planar body is infused with a combination of salt water and vinegar, the solution comprises the following ratio of salt water to vinegar 1 to 10 gallons of salt water to 1 gallon of vinegar; 2.5 to 7.5 gallons of salt water to 1 gallon of vinegar; 4 to 6 gallons of salt water to 1 gallon of vinegar; 4.5 to 5.5 gallons of salt water to 1 gallon of vinegar; or 5 galls of salt water to one gallon of vinegar.

Once the shavings are applied over the adhesive, the adhesive is cured. The adhesive may be sprayed onto the planar body or board, spread onto the planar body or board, or flocked onto the planar body or board. Additionally, the wood wick may be pressed to retain its shape, and to push the shavings further into the adhesive.

The wooden wick may be placed in a sustainer. A sustainer provides support to a wick that is in a candle. The wick can be inserted into the sustainer. The sustainer holding the wick may be positioned in the bottom of a container. The sustainer may be secured in place with an adhesive to hold the sustainer and wick in place at the bottom of the container. The sustainer may be self-extinguishing or heat resistant before the wick and sustainer are placed into the container that would hold the meltable fuel. Alternatively, the sustainer may be non-heat resistant or not be self-extinguishing. Examples of sustainers previously used can be found in U.S. Pat. Nos. 1,226,850; 1,267,968; 1,309,545; 1,320,109; 1,344,446; 1,505,092; 2,291,067; 2,324,753; 3,462,235; 3,998,922; and 4,381,914.

In one embodiment, the wood wick comprises a planar body, a planar booster and shavings adhered to the planar body or the planar booster. The planar body and the booster are joined or adhered together. They may be adhered together by any means of adhering two portions of a wick known in the industry, including by a fastener, clip, band, rivet, epoxy, cement, adhesive or the like. In a preferred embodiment, the planar body and the planar booster are adhered together by an adhesive. The adhesive may be any adhesive used to adhere wood together. The adhesive is preferably applied in an S pattern. In this embodiment, the shavings are adhered to at least one side of the planar body, or at least one side of the planer booster. Alternatively, the shavings may be adhered to the planar body and the planar booster.

In this embodiment, the booster may have a second predetermined width, a second predetermined thickness and a second predetermined length that are similar or identical to the predetermined width, predetermined thickness and/or the predetermined length of the planar body. In one embodiment, the second predetermined width is less than the predetermined width for the planar body.

In another embodiment, the wood wick comprises a planar body, a first planar booster, a second planar booster, and shavings adhered to at least one side or two sides of the planar body, first planar booster or the second planar booster. The second planar booster is adhered to the planar body in a manner discussed above with respect to the first planer booster. In this embodiment, the shavings are adhered to at least one side of the planar body, at least one side of the first planar booster or at least one side of the second planar booster. Alternatively, the shavings may be adhered to the first planar booster and the second planar booster.

In another embodiment, the invention is directed to a candle comprising a meltable fuel, and a wood wick, as described above. The meltable fuel may be a vegetable wax, such as soy wax, jojoba wax, bayberry wax, candelilla wax, carnauba wax, castor wax or a combination thereof.

In another embodiment, the invention is directed to a method of manufacturing a wood wick. The method comprising providing the planar body (or board), as described above. The adhesive, as described above, is applied over at least one side of the planar body. The shaving, as described above, is applied over at least a portion of the adhesive.

The planar body may be provided with a predetermined length, width and thickness, or it may be cut to the predetermined length, width and thickness as a final step of the method. The method may further comprise curing the adhesive.

The method may further comprise pressing the wood wick on a press board. The wood wick is pressed for a period of time, for example, at least 1 hour, at least 2 hours, at least 4 hours, or at least 8 hours. The pressing may occur after the shavings are joined to the planar body or booster, or after the adhesive is sprayed.

The method may further comprise heating the wood wick after the adhesive and shavings are applied. The heating step may comprise baking the wood wick. The baking step may comprise placing the wood wick in an oven set to a temperature between 100° F. and 250° F., between 125° F. and 200° F. and between 130° F. and 180° F. The heating step may occur over 1-12 hours, 2-10 hours, or 4-8 hours or about 8 hours.

In one embodiment, the wood wick is treated with a solution, as described above. This treatment step may occur after the adhesive has been cured, or after the pressing step described above. The solution may be sprayed onto the wood wick, or the wood wick may be soaked in the solution. Alternatively, the wood wick may be treated before the pressing step. In the event that the wood wick is treated before the pressing step, the adhesive should be cured before proceeding to the treating step. Alternatively, the wood wick may be treated before the shavings or adhesive are applied, or after the shavings and adhesive are applied.

The method may further comprise treating the planar body with the oil, described above. The oil may be sprayed onto the planar body, or the planar body may be soaked in the oil. The wood wick may be treated with the oil after the wood wick is treated with the solution, or before the wood wick is treated with the solution. The oil may be applied onto the wood wick before the wood wick is pressed, or after the wood wick is pressed. Alternatively, the wood wick may be treated before the shavings or adhesive are applied, or after the shavings and adhesive are applied.

The method may further comprise treating the wood wick with a vacuum. To do so, the wood wick is placed into a bag, and the bag is connected to a hose that is connected to a vacuum. This step may be done after the wood wick is treated with the oil, or before the wood wick is treated with the oil. This step may be done after the wood wick is treated with the solution, or before the wood wick is treated with the solution. This step may be done after the wood wick is pressed or before the wood wick is pressed. Alternatively, the wood wick may be treated with the vacuum before the shavings or adhesive are applied, or after the shavings and adhesive are applied.

In another embodiment the treating with oil step occurs after the adhesive and shavings are applied. In this embodiment, the oil is sprayed onto the wood wick, or the wood wick is soaked in the oil. The treating step may last for a time period, as described above, or, alternatively, the wood wick can be placed onto the press board soon after the oil is applied to the wood wick.

In another embodiment of the method of manufacturing a wood wick, comprising providing a board that is wood or wood-like material. The board may comprise a first board, a second board and an optional third board, wherein the second board and optional third board are adhered to or joined to the first board. The board may be coated with the shavings described above. The board may be treated with the oil. The board may be treated with the solution. The board may be treated with the vacuum. The board may be heated. In this particular embodiment, the method may further comprise cutting the board to form wood wicks have a predetermined length, predetermined width and predetermined thickness.

The planar body has a moisture content. Since wood can take-up moisture after processing, the moisture content for the purposes of this discussion means the moisture content at the final stage of processing. The final stage of processing can be after the last one of these steps is completed: after applying the shaving step; after the curing step; after the treating with the solution step; after the treating with the oil step; or after the treating with the vacuum step. The moisture content may be less than 10 percent, less than 8 percent, less than 6 percent, less than 4 percent, less than 3 percent or less than 2 percent.

Another embodiment of the invention is a method of manufacturing a candle. The candle comprises the wood wick, described above, and a meltable fuel, described above. For example, the wicks of the present invention may be placed in a container. The container may be filled with the meltable fuel. Alternatively, the wood wick may comprise a sustainer, described above, and the sustainer is first secured to the bottom of the container, and then the meltable fuel is poured into the container.

The wick of the present invention is made from all natural materials, and burns natural wax completely at a safe temperature. The planar body, the first planar booster, the second planar booster, the adhesive, and/or the shavings are all natural materials. By using all natural materials, better performance is achieved.

Referring to FIGS. 1-4, one embodiment of the invention is a wick 10 comprising a planar body 12 and shavings 14 adhered to at least one side of the planar body 12. The wick may be inserted into a sustainer 16 that is used to support the wick. The shavings 14 are adhered to the planar body 12 by an adhesive 18.

Figure 5:
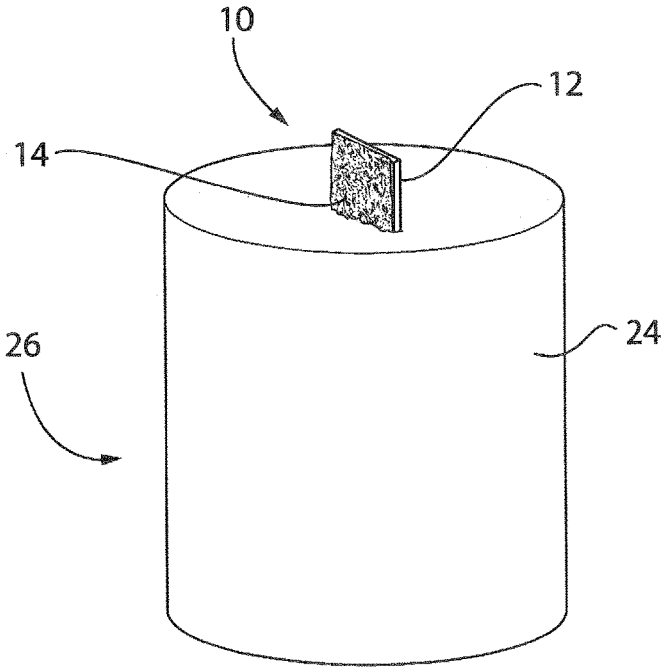
FIG. 5 is a perspective view of a wick with shavings on at least one side in a candle.

Referring to FIG. 5, another embodiment of the invention is a wick 10 comprising a planar body 12 and shavings 14 adhered to the planar body 12. The wick is inserted into a meltable fuel 24 to form a candle 26. A sustainer (not shown in FIG. 5) may be used to balance the wick before the meltable fuel 24 is added to the container that forms the candle 26.

Figure 6:
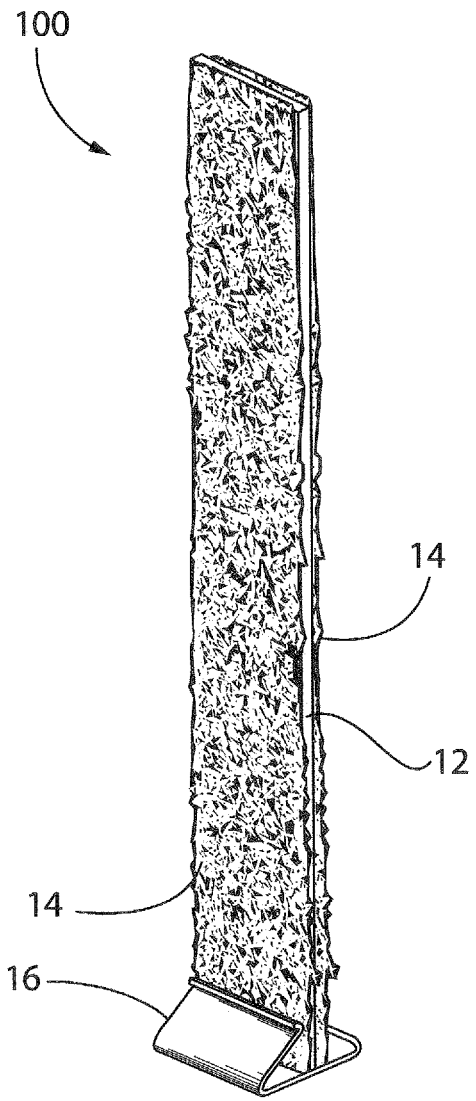
FIG. 6 is a perspective view of a wick with shavings on two sides in a sustainer.
Figure 7:
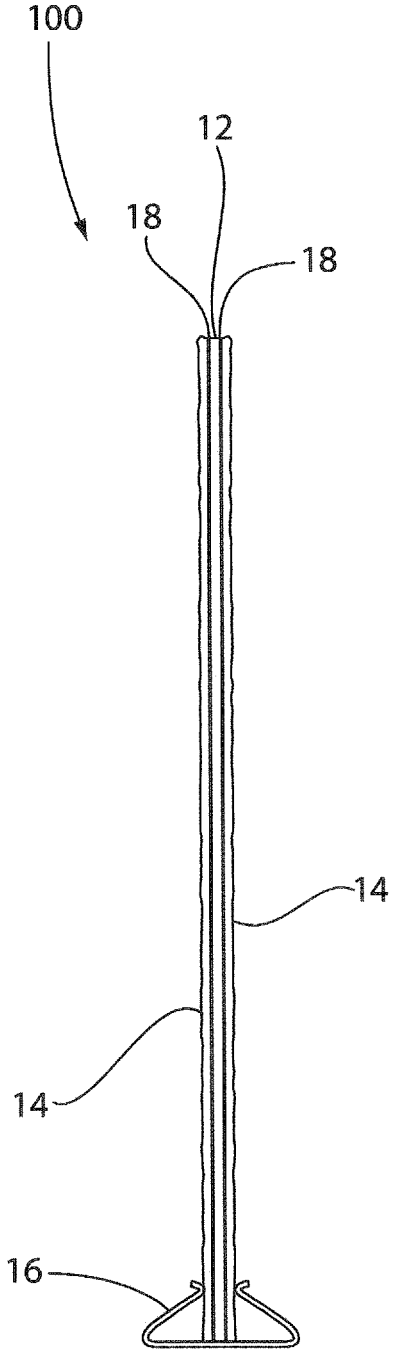
FIG. 7 is a cross-section side view of a wick with shavings on two sides in a sustainer.
Figure 8:
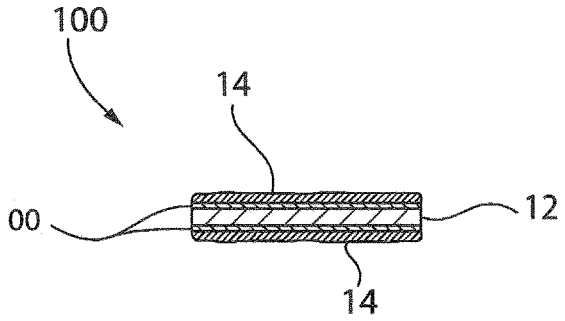
FIG. 8 is a cross-section top view of a wick with shavings on two sides.

Referring to FIGS. 6-8, another embodiment of the invention is a wick 10 comprising a planar body 12 and shavings 14 adhered to two sides of the planar body 12. The wick may be inserted into a sustainer 16 that is used to support the wick. The shavings 14 are adhered to the planar body 12 by an adhesive 18.

Figure 9:
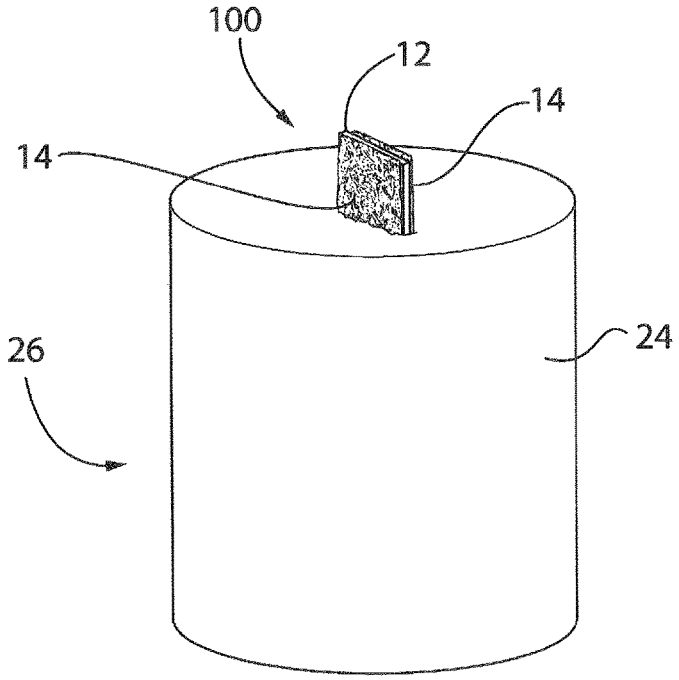
FIG. 9 is a perspective view of a wick with shavings on all sides in a candle.
Figure 10:
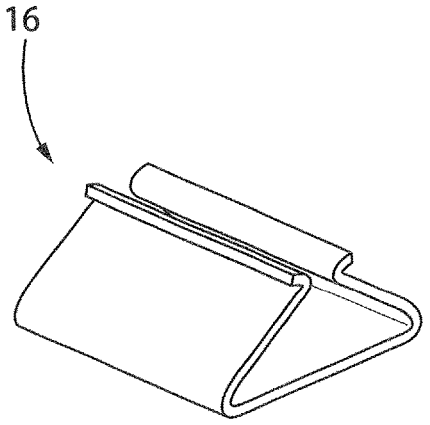
FIG. 10 is a perspective view of a sustainer.

Referring to FIG. 10, another embodiment of the invention is a wick 10 comprising a planar body 12 and shavings adhered to two sides of the planar body 12. The wick is inserted into a meltable fuel 24 to form a candle 26. A sustainer (not shown in FIG. 9) may be used to balance the wick before the meltable fuel 24 is added to the container that forms the candle 26.

FIG. 10 shows a sustainer 16. The sustainer may be used to balance a wick. The sustainer with wick may be inserted into a container before the meltable fuel is added. The sustainer will balance the wick while in the container. To ensure that the sustainer and wick do not move, the sustainer may be fastened to the container. An adhesive may be used to fasten the sustainer to the container. Thereafter, the meltable fuel is poured into the container.

While presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

The invention claimed is:

1. A planar wick, comprising:

a planar body with a first predetermined length, a first predetermined width, and a first predetermined thickness; and shavings;

wherein;

at least one surface of the planar body is coated with the shavings; and the shavings have a coarseness of grade A to grade CC.

2. The wick according to claim 1, further comprising an adhesive that adheres the shavings to the planar body.

3. The wick according to claim 1, wherein the shavings are wood flour.

4. The wick, according to claim 1, wherein the planar body and shavings are infused with at least one of an oil, a solution comprising salt water, and a solution comprising vinegar.

5. The wick according to claim 1, wherein the planar body and shavings have been subjected to at least one of treatment with a vacuum and baking.

6. The wick according to claim 1, further comprising a planar booster, wherein the planar booster differs from the planar body in at least one of width, thickness, and length.

7. The wick according to claim 6, wherein a major surface of the planar body is adhered to a major surface of the planar booster.

8. The wick according to claim 6, wherein the shavings are adhered to at least one side of the planar body and at least one side of the planar booster.

9. The wick according to claim 6, further comprising a second planar booster.

10. The wick according to claim 9, wherein a major surface of the planar body is adhered to a major surface of the second planar booster.

11. The wick according to claim 1, wherein the shavings are natural shavings.

12. The wick according to claim 1, wherein the shavings comprise wood.

13. A method of manufacturing a wick, comprising:

(a) cutting to obtain a planar strip having each of a first predetermined length, a first predetermined width, and a first predetermined thickness;

(b) forming a booster member having each of a second predetermined length, a second predetermined width, and a second predetermined thickness;

(c) joining the booster member to the planar body to form the wick; and (d) applying a treatment to at least a portion of the planar body;

wherein;

the wick comprises shavings; and the treatment comprises at least one treatment selected from the group consisting of pressing on a press board, treating with a solution comprising vinegar and/or salt, treating with an oil or meltable fuel, and coating an entirety of the strip and/or booster with an adhesive and shavings.

14. The method according to claim 13, wherein the booster member comprises an adhesive.

15. A wick, comprising:

a planar body, a booster member; and shavings;

wherein;

the wick is obtained by a method comprising adhering the shavings to at least one surface of the wick; and a portion of the wick is sealed with oil or meltable fuel.

16. The wick according to claim 15, wherein the planar body and shavings are infused with at least one of an oil, a solution comprising salt water, and a solution comprising vinegar.

17. The wick according to claim 15, wherein the planar body and shavings have been subjected to at least one of treatment with a vacuum and baking.

18. The wick according to claim 15, wherein the shavings are adhered to at least one side of at least one of the planar body and the planar booster.

19. The wick according to claim 15, wherein the booster member differs from the planar body in at least one of width, thickness, and length.

20. The wick according to claim 15, wherein a major surface of the planar body is adhered to a major surface of the booster member.

21. The wick according to claim 15, wherein the shavings are adhered to at least one side of the planar body and at least one side of the planar booster member.

22. The wick according to claim 15, further comprising a second booster member.

23. The wick according to claim 22, wherein a major surface of the planar body is adhered to a major surface of the second booster member.

24. The wick according to claim 15, wherein the shavings are natural shavings.

25. The wick according to claim 15, wherein the shavings comprise wood.

26. The wick according to claim 15, wherein the booster member comprises an adhesive.

* * * * *